US009669524B1

(12) United States Patent
Bowling

(10) Patent No.: US 9,669,524 B1
(45) Date of Patent: Jun. 6, 2017

(54) RATCHETING BOX WRENCH

(71) Applicant: Jackie Bowling, Knoxville, TN (US)

(72) Inventor: Jackie Bowling, Knoxville, TN (US)

( * ) Notice: Subject to any disclaimer, the term of this patent is extended or adjusted under 35 U.S.C. 154(b) by 303 days.

(21) Appl. No.: 14/558,774

(22) Filed: Dec. 3, 2014

(51) Int. Cl.
*B25B 21/00* (2006.01)
*B25B 13/46* (2006.01)
*B25B 13/48* (2006.01)
*B25B 23/00* (2006.01)

(52) U.S. Cl.
CPC ..... *B25B 21/004* (2013.01); *B25B 13/463* (2013.01); *B25B 13/481* (2013.01); *B25B 23/0035* (2013.01)

(58) Field of Classification Search
CPC ... B25B 21/004; B25B 13/463; B25B 13/481; B25B 23/0035
USPC ..... 81/57.13, 57.29
See application file for complete search history.

(56) References Cited

U.S. PATENT DOCUMENTS 2,594,669 A * 4/1952 Marshall ..... B25B 13/481 81/36
3,733,936 A * 5/1973 Flynn ..... B25B 17/00 81/57.29
3,972,252 A * 8/1976 Hunter ..... B25B 13/481 81/57.29
4,215,601 A * 8/1980 Mann ..... B25F 3/00 81/57.13
4,240,310 A * 12/1980 Roth ..... B25B 21/00 81/57.29
4,474,089 A * 10/1984 Scott ..... B25B 17/00 81/57.29
4,524,650 A * 6/1985 Marks ..... B25B 13/46 173/170
4,748,875 A 6/1988 Lang
5,584,220 A * 12/1996 Darrah ..... B25B 13/463 81/57.29
5,713,251 A 2/1998 Zurbuchen
6,050,165 A 4/2000 Hall
6,148,694 A * 11/2000 Spirer ..... B25B 13/463 81/57.3
6,260,443 B1 * 7/2001 Spirer ..... B25B 13/463 81/57.3
6,330,842 B1 * 12/2001 Brun ..... B25B 21/004 81/57.39
D492,556 S 7/2004 Barry
7,062,992 B2 * 6/2006 Spirer ..... B25B 13/463 81/57.3
7,089,827 B2 * 8/2006 Wexler ..... B25B 13/481 81/169
7,152,508 B2 12/2006 McCalley, Jr. et al.
7,571,668 B1 * 8/2009 Chang ..... B25B 13/481 81/57.29

(Continued)

FOREIGN PATENT DOCUMENTS

WO WO 1998050202 11/1998

*Primary Examiner* — David B Thomas

(57) ABSTRACT

The ratcheting box wrench includes a box wrench that includes a ratcheting socket inside of the wrench opening. The ratcheting socket is in mechanical connection with a square drive that is provided at a distal end of the handle such that a square drive bit is able to rotate the ratcheting socket. Moreover, the square drive bit is affixed to the square drive provided at the distal end of the handle, and rotation of the square drive shall drive the ratcheting socket provided inside of the wrench opening of the box wrench portion of the ratcheting box wrench.

10 Claims, 4 Drawing Sheets

(56) References Cited

U.S. PATENT DOCUMENTS

| | | | | |
|---|---|---|---|---|
| 8,069,753 | B2 | 12/2011 | Kriz | |
| 8,459,151 | B2 | 6/2013 | Wang | |
| 9,038,505 | B2 * | 5/2015 | He | B25B 17/00 81/57.29 |
| 9,149,916 | B2 * | 10/2015 | Kiser | B25B 13/481 81/57.29 |
| 9,440,338 | B2 * | 9/2016 | Crawford | B25B 17/00 81/57.3 |
| 2011/0094352 | A1 | 4/2011 | Reinstein | |
| 2012/0297939 | A1 * | 11/2012 | Spata | B25B 13/463 81/478 |
| 2015/0258668 | A1 * | 9/2015 | Crawford | B25B 17/00 81/57.3 |

* cited by examiner

RATCHETING BOX WRENCH

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of hand tools, more specifically, a box wrench that includes a ratcheting member integrated into the handle.

SUMMARY OF THE INVENTION

An embodiment of the disclosure meets the needs presented above by generally comprising a box wrench that includes a ratcheting socket inside of the wrench opening. The ratcheting socket is in mechanical connection with a square drive that is provided at a distal end of the handle such that a square drive bit is able to rotate the ratcheting socket. Moreover, the square drive bit is affixed to the square drive provided at the distal end of the handle, and rotation of the square drive shall drive the ratcheting socket provided inside of the wrench opening of the box wrench portion of the ratcheting box wrench.

These together with additional objects, features and advantages of the ratcheting box wrench will be readily apparent to those of ordinary skill in the art upon reading the following detailed description of presently preferred, but nonetheless illustrative, embodiments of the ratcheting box wrench when taken in conjunction with the accompanying drawings.

In this respect, before explaining the current embodiments of the ratcheting box wrench in detail, it is to be understood that the ratcheting box wrench is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the ratcheting box wrench.

It is therefore important that the claims be regarded as including such equivalent construction insofar as they do not depart from the spirit and scope of the ratcheting box wrench. It is also to be understood that the phraseology and terminology employed herein are for purposes of description and should not be regarded as limiting.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DETAILED DESCRIPTION OF THE EMBODIMENT

Figure 1:
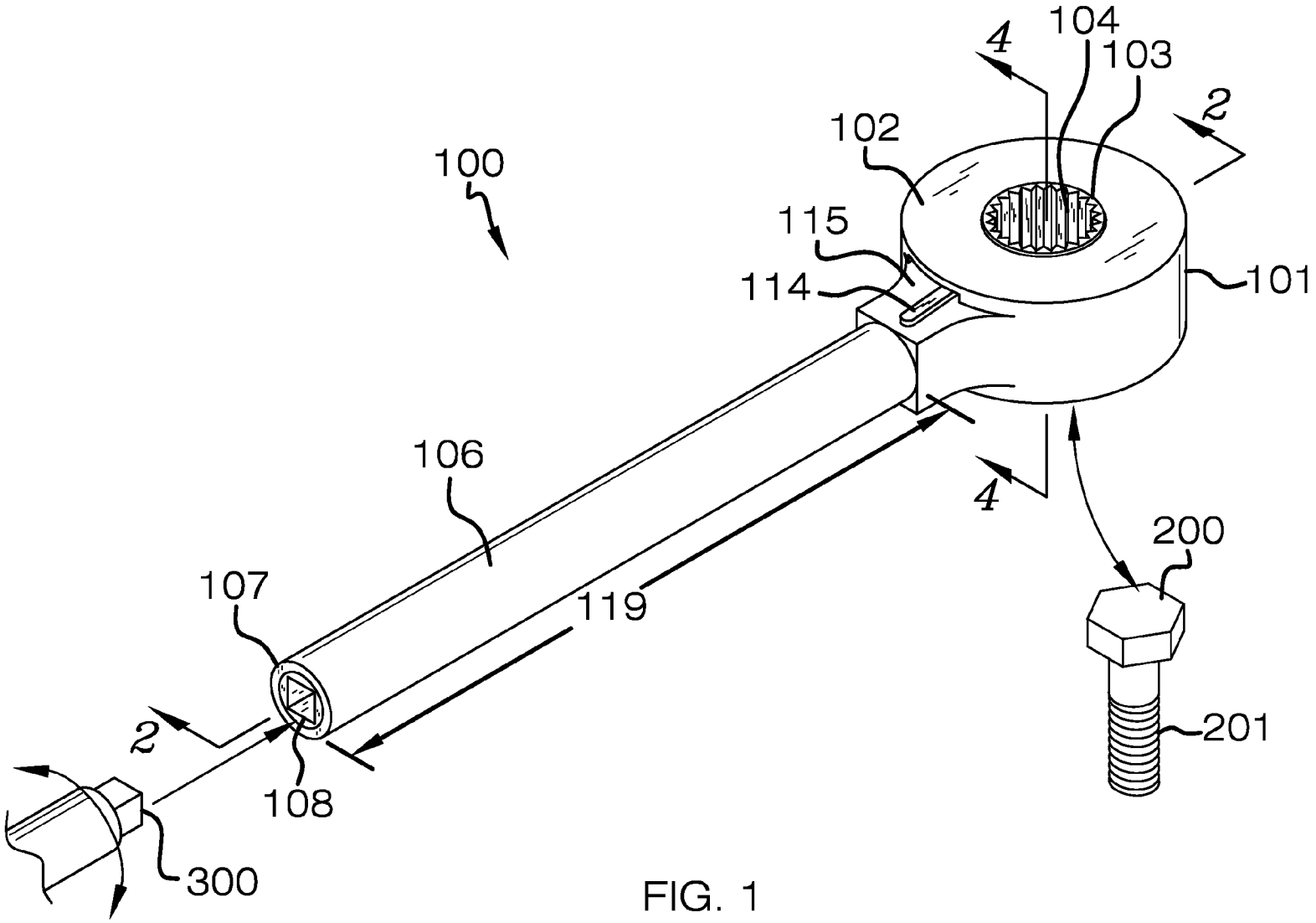
FIG. 1 is a perspective view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

As best illustrated in FIGS. 1 through 4, the ratcheting box wrench 100 (hereinafter invention) generally comprises a box wrench 101 that is further defined with a casing 102 that extends to an opening 103 where a ratcheting socket 104 is provided. The ratcheting socket 104 rotates about a vertical axis 105. The ratcheting socket 104 is configured to be placed over a bolt head 200 in order to tighten or loosen a bolt 201. It shall be noted that the bolt 201 may be a screw or other type of fastener.

The box wrench 101 is affixed to a handle 106 that extends laterally from the casing 102. The handle 106 is of hollowed construction, and is further defined with a distal end 107. The distal end 107 is opposite of where the handle 106 joins the casing 102. The distal end 107 of the handle 106 includes a square drive 108 therein. The square drive 108 is able to rotate about a horizontal axis 109. More importantly, the square drive 108 is in mechanical connection with the ratcheting socket 104. The square drive 108 is able to drive the ratcheting socket 104. However, the ratcheting socket 104 is able to operate in a more traditional manner whereby the handle 106 rotates the box wrench 101 with the ratcheting socket 104 therein.

Figure 2:
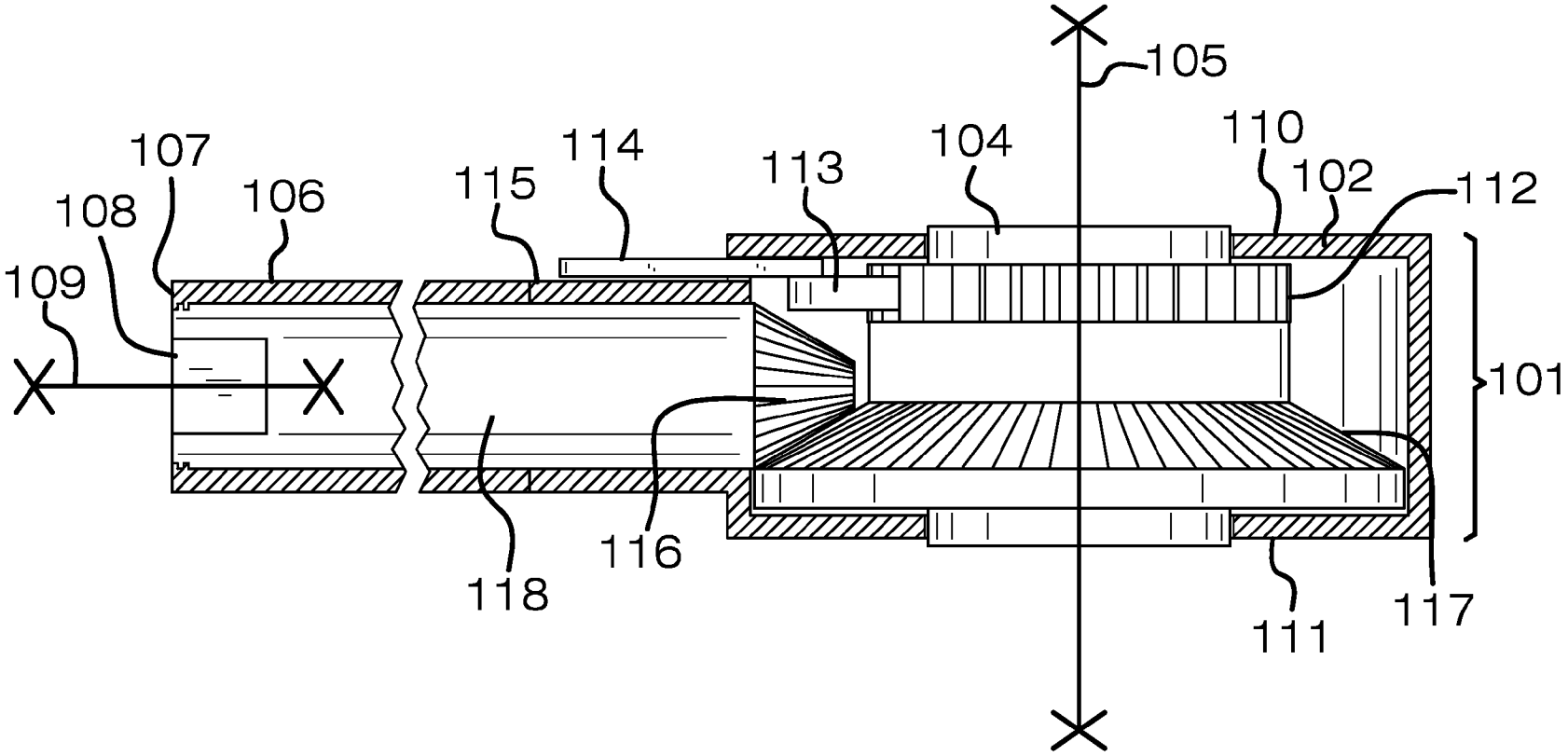
FIG. 2 is a cross-sectional view along line 2-2 in FIG. 1 of an embodiment of the disclosure.
Figure 3:
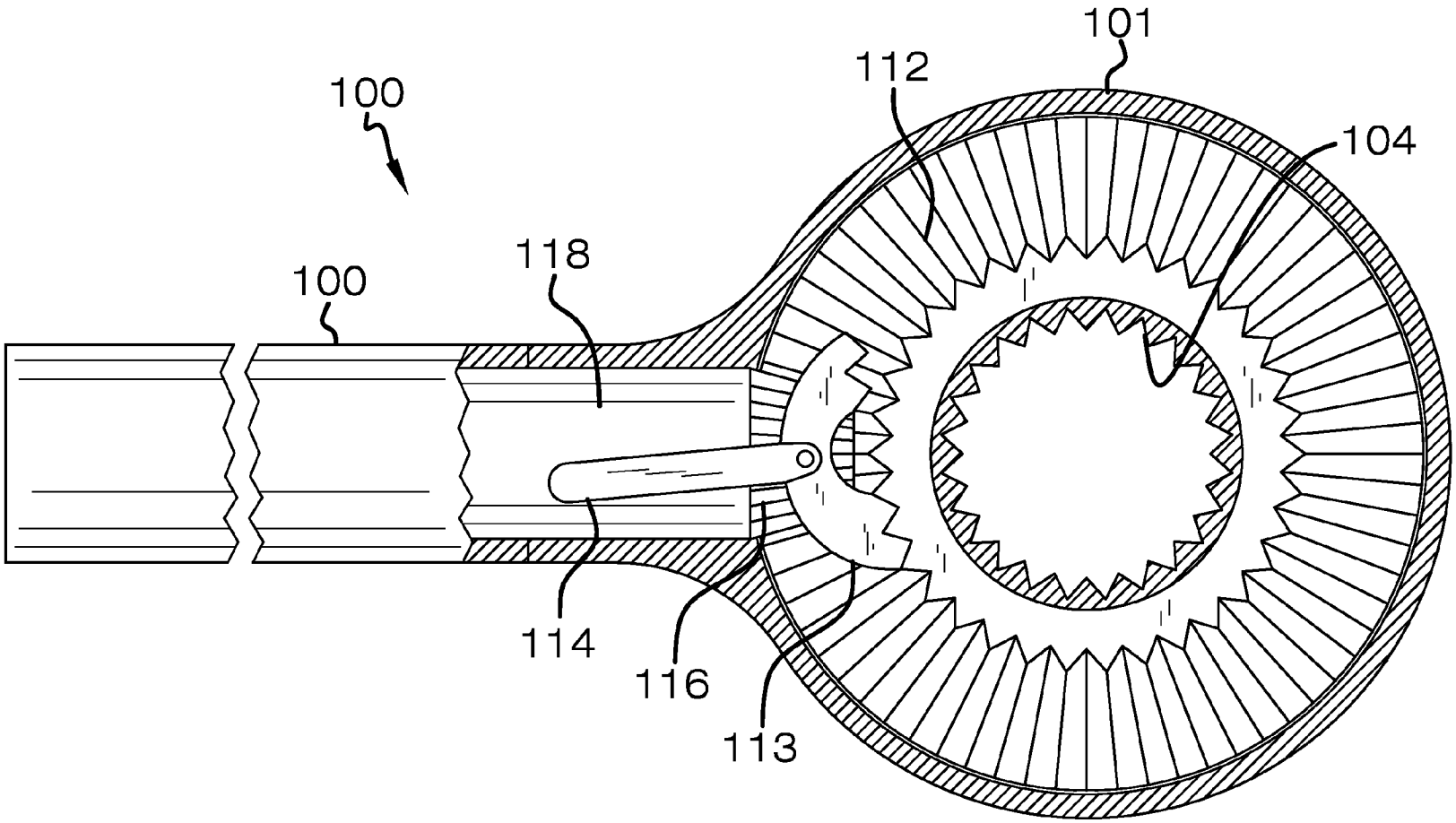
FIG. 3 is a cut-away view of an embodiment of the disclosure.
Figure 4:
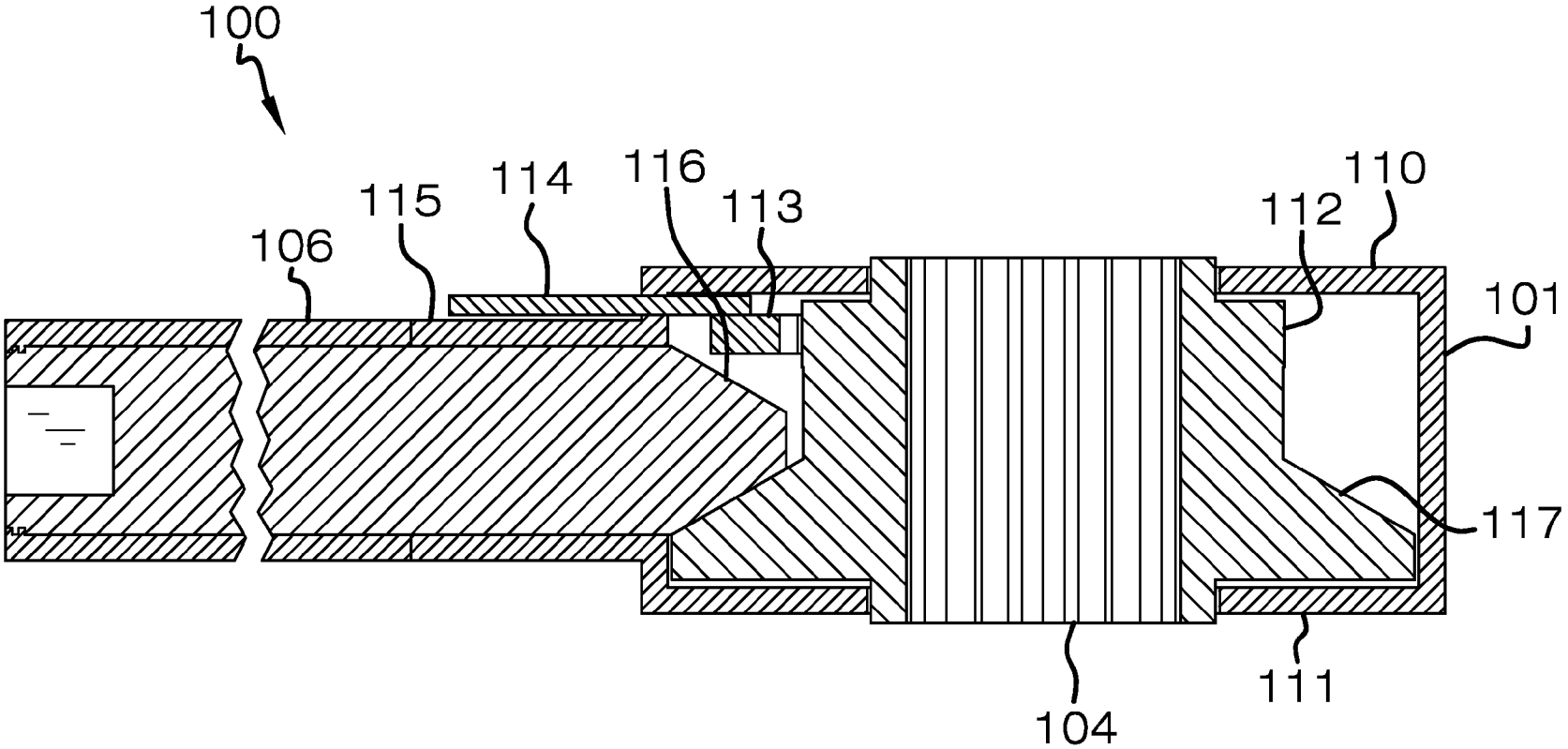
FIG. 4 is another cross-sectional view along line 4-4 in FIG. 1 of an embodiment of the disclosure.

Referring to FIG. 2, the ratcheting socket 104 extends across the casing 102. It shall be noted that the casing 102 is located on a top box wrench surface 110 as well as a bottom box wrench surface 111. The ratcheting socket 104 includes a ratcheting gear 112 located inside of the casing 102. The ratcheting gear 112 is connected to a locking pawl gear 113. The locking pawl gear 113 is well known in the art of ratcheting tools. Moreover, the locking pawl gear 113 locks the ratcheting socket 104 into either clockwise or counterclockwise motion. The locking pawl gear 113 is adjusted via a locking pawl 114 that is provided at a casing recess 115. The locking pawl 114 is able to be turned left or right in order to secure the locking pawl gear 113 in clockwise or counterclockwise movement of the ratcheting socket 104. The locking pawl gear 113 includes a clockwise action 120 and a counterclockwise action 121, which are set upon rotation of the locking pawl 114.

Located inside of the casing 102 is a square drive gear 116. The square drive gear 116 engages a second ratcheting gear 117. The second ratcheting gear 117 is affixed to the ratcheting gear 112 such that both the second ratcheting gear 117 and the ratcheting gear 112 move in unison. The square drive gear 116 is affixed to a square drive armature 118 that extends down a handle length 119 to the square drive 108 at the distal end 107 of the handle 106. The square drive 108 is configured to be attached to a square drive bit 300 in order to rotate the square drive 108 either clockwise or counterclockwise with respect to the horizontal axis 109 thereby rotating the ratcheting socket 104 acccordingly.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A ratcheting box wrench comprising:

a ratcheting socket integrated into a casing of a box wrench;

said ratcheting socket is configured to engage a bolt head in order to tighten or loosen said bolt head;

a handle extends from said casing;

said handle includes a square drive that is in mechanical connection with the ratcheting socket;

said square drive is able to rotate in order to drive the ratcheting socket;

wherein the casing includes an opening where the ratcheting socket is provided;

wherein the ratcheting socket rotates about a vertical axis;

wherein the handle extends laterally from the casing;

wherein the handle is of hollowed construction, and is further defined with a distal end;

wherein the distal end is opposite of where the handle joins the casing;

wherein the square drive is able to rotate about a horizontal axis;

wherein the vertical axis is perpendicular with respect to the horizontal axis;

wherein the square drive is able to drive the ratcheting socket;

wherein the ratcheting socket is able to operate whereby the handle rotates the box wrench with the ratcheting socket therein;

wherein the ratcheting socket extends across the casing;

wherein the casing is located on a top box wrench surface as well as a bottom box wrench surface.

2. The ratcheting box wrench according to claim 1 wherein the ratcheting socket includes a ratcheting gear located inside of the casing; wherein the ratcheting gear is connected to a locking pawl gear.

3. The ratcheting box wrench according to claim 2 wherein the locking pawl gear locks the ratcheting socket into either clockwise or counterclockwise motion; wherein the locking pawl gear is adjusted via a locking pawl that is provided at a casing recess; wherein the locking pawl is able to be turned left or right in order to secure the locking pawl gear in clockwise or counterclockwise movement of the ratcheting socket.

4. The ratcheting box wrench according to claim 3 wherein the locking pawl gear includes a clockwise action and a counterclockwise action, which are set upon rotation of the locking pawl.

5. The ratcheting box wrench according to claim 4 wherein located inside of the casing is a square drive gear; wherein the square drive gear engages a second ratcheting gear; wherein the second ratcheting gear is affixed to the ratcheting gear such that both the second ratcheting gear and the ratcheting gear move in unison.

6. The ratcheting box wrench according to claim 5 wherein the square drive gear is affixed to a square drive armature that extends down a handle length to the square drive at the distal end of the handle.

7. A ratcheting box wrench comprising:

a ratcheting socket integrated into a casing of a box wrench;

said ratcheting socket is configured to engage a bolt head in order to tighten or loosen said bolt head;

a handle extends from said casing;

said handle includes a square drive that is in mechanical connection with the ratcheting socket;

said square drive is able to rotate in order to drive the ratcheting socket;

wherein the casing includes an opening where the ratcheting socket is provided;

wherein the ratcheting socket rotates about a vertical axis;

wherein the handle extends laterally from the casing;

wherein the handle is of hollowed construction, and is further defined with a distal end;

wherein the distal end is opposite of where the handle joins the casing;

wherein the square drive is able to rotate about a horizontal axis;

wherein the vertical axis is perpendicular with respect to the horizontal axis;

wherein the square drive is able to drive the ratcheting socket;

wherein the ratcheting socket is able to operate whereby the handle rotates the box wrench with the ratcheting socket therein;

wherein the ratcheting socket extends across the casing;

wherein the casing is located on a top box wrench surface as well as a bottom box wrench surface;

wherein the ratcheting socket includes a ratcheting gear located inside of the casing;

wherein the ratcheting gear is connected to a locking pawl gear;

wherein the locking pawl gear locks the ratcheting socket into either clockwise or counterclockwise motion;

wherein the locking pawl gear is adjusted via a locking pawl that is provided at a casing recess;

wherein the locking pawl is able to be turned left or right in order to secure the locking pawl gear in clockwise or counterclockwise movement of the ratcheting socket.

8. The ratcheting box wrench according to claim 7 wherein the locking pawl gear includes a clockwise action and a counterclockwise action, which are set upon rotation of the locking pawl.

9. The ratcheting box wrench according to claim 8 wherein located inside of the casing is a square drive gear; wherein the square drive gear engages a second ratcheting gear; wherein the second ratcheting gear is affixed to the ratcheting gear such that both the second ratcheting gear and the ratcheting gear move in unison.

10. The ratcheting box wrench according to claim 9 wherein the square drive gear is affixed to a square drive armature that extends down a handle length to the square drive at the distal end of the handle.

* * * * *